United States Patent [19]

Jenkins

[11] Patent Number: 5,076,365

[45] Date of Patent: Dec. 31, 1991

[54] DOWN HOLE OIL FIELD CLEAN-OUT METHOD

[75] Inventor: Robert L. Jenkins, New Iberia, La.

[73] Assignee: Charles D. Hailey, Oklahoma City, Okla.

[21] Appl. No.: 460,570

[22] Filed: Jan. 3, 1990

Related U.S. Application Data

[63] Continuation of Ser. No. 344,313, Apr. 27, 1989, abandoned, which is a continuation of Ser. No. 940,267, Dec. 11, 1986, Pat. No. 4,838,354.

[51] Int. Cl.[5] ..... E21B 37/04

[52] U.S. Cl. ..... 166/311; 166/173; 166/174; 166/312; 166/384

[58] Field of Search ..... 166/311, 55.8, 170, 166/174, 177, 312, 55.3, 384

[56] References Cited

U.S. PATENT DOCUMENTS

| | | | |
|---|---|---|---|
| Re. 21,824 | 6/1941 | Lowrey | 166/55.8 X |
| 1,271,511 | 7/1918 | Gregory et al. | 166/172 |
| 1,282,976 | 10/1918 | Stubbs et al. | 166/172 |
| 2,180,452 | 11/1939 | Boulter | 175/267 |
| 2,218,766 | 10/1940 | Parker | 166/55.8 |
| 2,284,211 | 5/1942 | Justice | 166/55.8 X |
| 2,328,782 | 9/1943 | Bynum . | |
| 2,481,637 | 9/1949 | Tancey | 166/55.8 X |
| 3,050,122 | 8/1962 | Huitt et al. | 166/55.8 |
| 3,073,389 | 1/1963 | Conner | 166/55.8 |
| 3,220,478 | 11/1965 | Kinzbach | 166/55.8 |
| 3,378,072 | 4/1968 | Smith . | |
| 3,468,373 | 9/1969 | Smith | 166/55.8 |
| 3,662,828 | 5/1972 | Hutchison | 166/312 |
| 4,068,711 | 1/1978 | Aulenbacher | 166/55.3 |
| 4,190,113 | 2/1980 | Harrison | 166/311 |
| 4,518,041 | 5/1985 | Zublin | 166/312 |
| 4,646,826 | 3/1987 | Bailey et al. | 166/55.8 X |
| 4,809,793 | 3/1989 | Hailey | 175/265 |

OTHER PUBLICATIONS

SPE 8209 Publication Entitled, "Concentric Workover Operations in Deep Sour Wells", by N. E. Fincher, 1979.

SPE 18256 Publication Entitled, "Innovative Technology in Producing Operations", by D. D. Hearn et al., 1988 p. 1.

SlimDril Brochure Entitled, "Advanced Drilling Motors Workover Systems PDC Bits Guidance Tools Borehole Instrumentation", Reprinted from 36th (1984–1985), Composite Catalog.

*Primary Examiner*—Stephen J. Novosad

*Attorney, Agent, or Firm*—Laney, Dougherty, Hessin & Beavers

[57] ABSTRACT

A clean-out tool system for use with a oil well production tubing extending downward through a casing terminating in a production zone in the well bore, which zone is isolated by a packer and includes flow restricting debris to be cleaned out. A generally vertical, elongated, cylindrical tool body, having a relatively small diameter and a bore therein, is located down through the inner production tubing into the zone located at the end of a tubing string extending downward through the production tubing for communicating fluid pressure to the bore in the body. Four, peripherally spaced, elongated slots extend radially inward into the body with their longitudinal axes aligned with the longitudinal axis of the body and communicate with the bore is the body. An elongated blade is pivotally attached in each slot to the body, movable from a first configuration wherein the blade is positioned vertically within the slot, and a second, expanded configuration positioned radially outward in the zone. The blade is pivoted to its second configuration responsive to increasing pressure in the tubing string and is limited in its movement by the degree of an upper cam face onthe blade preventing any cutting engagement between the clean-out blades and the interior surfaces of the casing. The tubing string is moved longitudinally and rotated, rotating and moving the blade in its second configuration within the zone, loosening debris which is then removed by fluid circulation. The blades are provided in sets for different expansion sizes.

1 Claim, 3 Drawing Sheets

62
30'
18
32
64A 12
10A
66
82
68
76
76
70
10
30
26
28
28
20
72
18
18
32
32
32
80
48

62
30'
18
64B
32

62
30'
32
6AC 62
30'
32

10A
14
92
10
26
28
28
20
18
18
18
32
32'

38

38
46
38

38

34
34
42
42
44
42
34
42
40
36
90

34

52
48

58

10A
14

52
54
48
56

56

DOWN HOLE OIL FIELD CLEAN-OUT METHOD

This application is a continuation of application Ser. No. 07/344,313, filed Apr. 27, 1989 now abandoned, which application is a continuation of Ser. No. 06/940,267 filed Dec. 11, 1986 and issued as U.S. Pat. No. 4,838,354 on June 13, 1989.

BACKGROUND OF THE INVENTION

1. Field of the Invention

The present invention relates to a tool system and method for cleaning out restrictions located substantially downhole in oil wells and the like, and more particularly to a tool system for cleaning out the zone below a packer without the need for removing the packer, utilizing a tool which has a relatively small diameter, less than the diameter of the production tubing, but having radically extendable cleaning blades which are expanded out after the tool is longitudinally moved through the production tubing and located down below the packer. The zone below the packer to be cleaned out is filled with debris restricting flow from the zone to the interior of the production tubing, and the tool system of the invention in its expanded configuration rotated about its longitudinal axis, moving the blade within the zone to loosen the debris, which is then removed by fluid circulation. Additionally, the present invention relates to such a tool having a replaceable blade set allowing for the same tool to be used for different diameter casings.

2. Prior Art and General Background

Following drilling operations for an oil or gas well, a string of steel casing is installed into the well bore to isolate the producing interval or zone from other formations. A string of steel production tubing is installed longitudinally inside the casing with a packer set above the production perforations, and the well is produced through the production tubing. Often times a sand screen is set opposite the production perforations to restrict entry of sand grains from unconsolidated sandstone formations into the casing and tubing. In the event this precautionary measure is inadequate, or for other reasons, which may exist over a period of time, such as scale, corrosion, etc., flow from the well may become restricted or cease, requiring clean-out of the debris in the zone below the packer.

The usual procedure to resolve this problem has been to employ a workover rig, kill the well with weighted drilling fluids, retrieve the tubing and packer, and clean out the restriction or debris. This operation is considerably expensive, especially when the tubing and packer cannot be easily retrieved.

In general it would not be suitable to use apparatus for severing well casing such as described in Smith, U.S. Pat. No. 3,378,072 issued on Apr. 16, 1968, as the apparatus was not intended to be made in a size small enough to be lowered through the interior of a production tubing string, which is generally in the neighborhood of 2 ½–4 ½ inches, and the apparatus would, in any event, sever the casing and would not be suitable for movement of the blade longitudinally along the axis of the casing while the blade is rotated. For other examples of apparatus for severing well casing, see for example U.S. Pat. Nos. 4,068,711 (issued Jan. 17, 1978 to Aulenbacher); 2,328,782 (issued Sept. 7, 1943 to P. T. Bynum); 2,284,211 (issued May 26, 1942 to G. E. Justice); and RE 21,824 (issued June 10, 1941 to G. A. Lowrey).

GENERAL DISCUSSION OF THE INVENTION

In contrast the present invention relates to a special tool and method of accomplishing the results by employing a small hydraulically driven clean-out tool that is conveyed on small diameter tubing down through the production tubing and packer. This smaller tubing requires lighter, less expensive hoisting equipment and obviates the need for any fishing operations, since the production tubing and packer remain in place.

Also, the operation can be conducted under pressure without killing the well, by employing small tubing, hydraulic snubbing or coil tubing hoisting equipment and a down-hole motor (e.g. a "Dynadril" motor).

The present invention is designed to clean out the smaller inside diameter of the producting tubing as the tool is lowered, and then, after the packer has been positioned below the packer, expand the took, by for example pivoting out a set of clean-out blades, and cleaning out the larger, inside diameter of the casing by rotating the expanded tool. It is noted that in no way is the tool of the invention designed to cut, penetrate or remove the casing wall or enlarge any open hole section of the well bore.

Thus, the present invention is able to clean out all the restricting formations without the need for removing the packer or the production tubing and to do so without a relatively inexpensive, flexible and highly reliable tool and method.

Additionally, the tool is preferably supplied with a series of differently configured, pivotable clean-out blade sets, so that the same tool body and related equipment can be used for different diameter casings. The difference in configuration of the blade sets is of primary importance at the upper ends, as their degree of bias or angularity will determine the outwardly pivoted disposition and hence their effective clan-out diameter as the tool is rotated. Additionally such configuration insures that, for a particular diameter casing, the clean-out blades will not cuttingly engage the inside surface of the casing and effectively limits the radial expansion of the tool.

It is therefore an object of the present invention to provide a new method and apparatus suitable for loosening the debris in an isolated zone below a packer which will not require the removal of the packer or the production tubing.

It is further an object of the present invention that the method and apparatus of the present invention allow circulation downward through the tubing string into the zone for circulating the debris out of the zone.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DESCRIPTION OF THE PREFERRED, EXEMPLARY EMBODIMENT(s)

Figures 1, 7A, 7B:
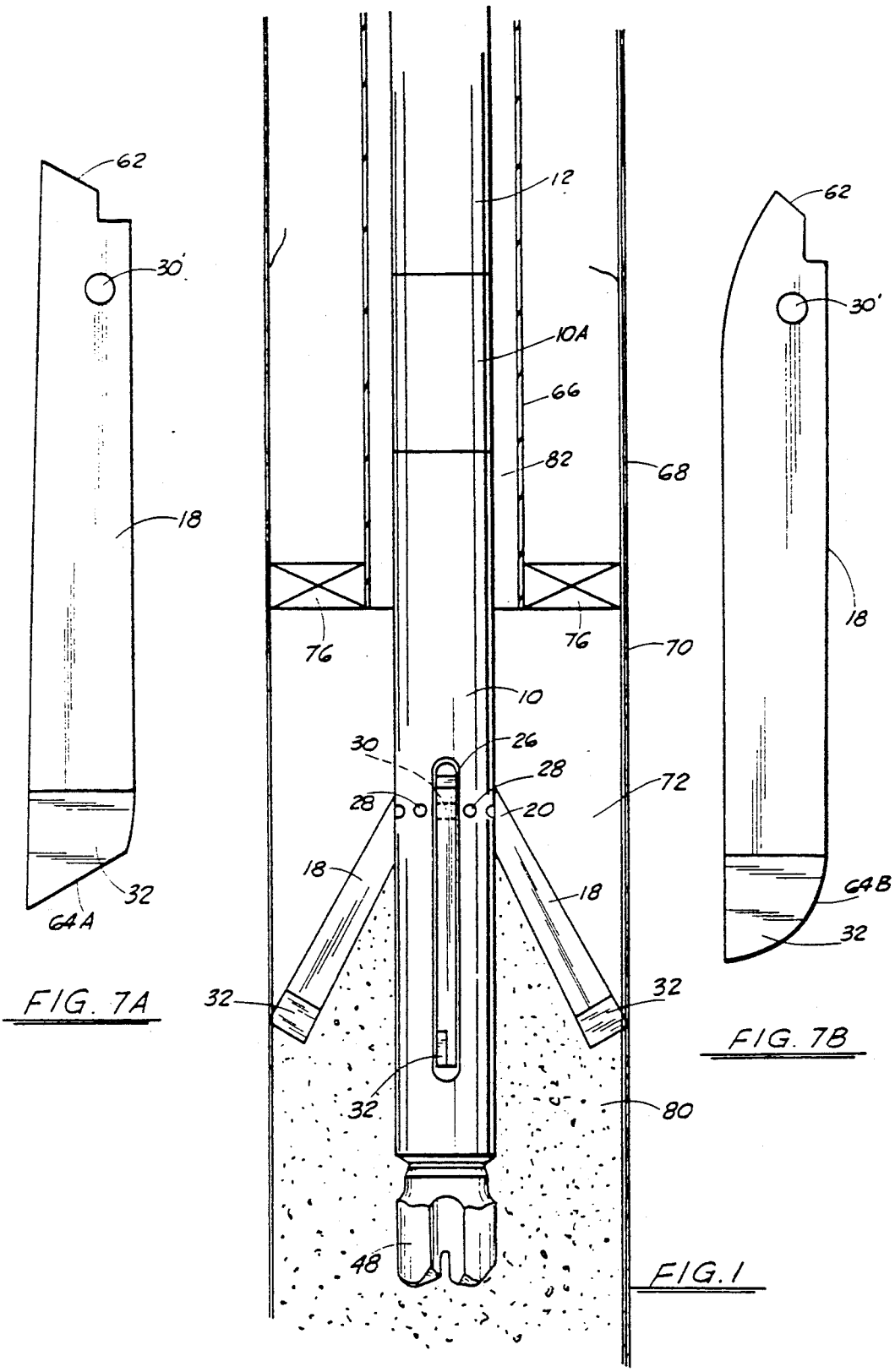
FIG. 1 is a side view of the preferred embodiment of the clean-out tool system according to the method and apparatus of the present invention.
FIGS. 7A is a side view of a preferred embodiment of an elongated blade pivotally attached to the body of the tool system of the method and apparatus of the present invention shown in FIG. 1.
FIG. 7B is a side view of a second preferred embodiment of an elongated blade pivotally attached to the body of the tool system of the method and apparatus of the present invention shown in FIG. 1.
Figure 3A:
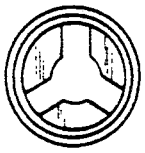
FIG. 3 is a side, cross-sectional view, including top and bottom end views, FIGS. 3A and 3B, of the tool body of the tool system of FIG. 1.
Figure 3:
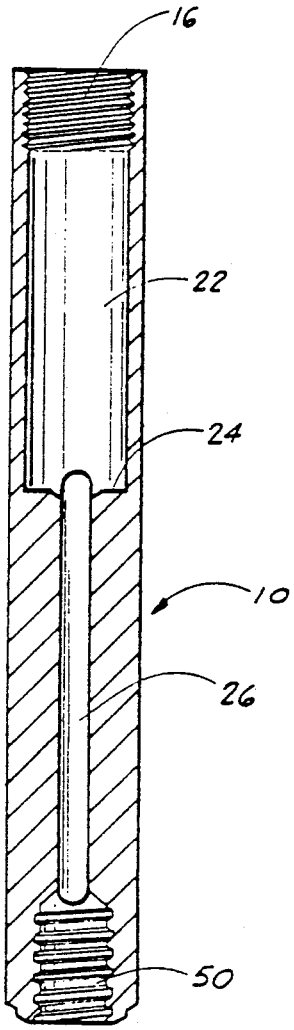
Figure 3B:
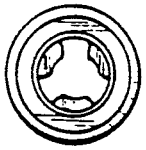
Figure 2:
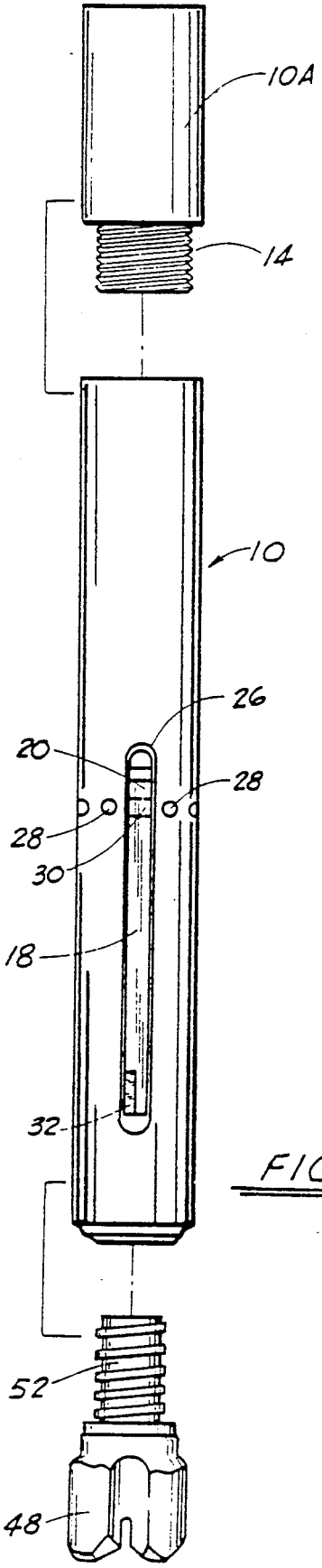
FIG. 2 is a side, exploded view of portions of the tool system of FIG. 1.

Referring to FIG. 1, the preferred embodiment of the clean-out tool system S according to the method and apparatus of the present invention is seen. The tool system S includes an elongated body 10 and a connecting means on its upper end for connecting the body 10 to the lower end of a tubing string 12. The connecting means, as shown in FIG. 2, may be any standard connection known to the art, such as a threaded portion 14 extending axially from sub 10A (or a tubing string 12 if a sub is not needed), which is threadably engaged in a threaded counterbore 16 as shown in FIG. 3, and which is suitable for connecting body 10 to tubing string 12. As shown in the figures, a sub 10A is disposed, if needed, between the tool body 10 and the tubing string 12 for purposes which will be described later.

Figures 4, 4A, 4B, 5, 5A, 5B, 5C, 6, 6A, 6B, 6C, 8, 8A, 9, 9A, 9B, 10:
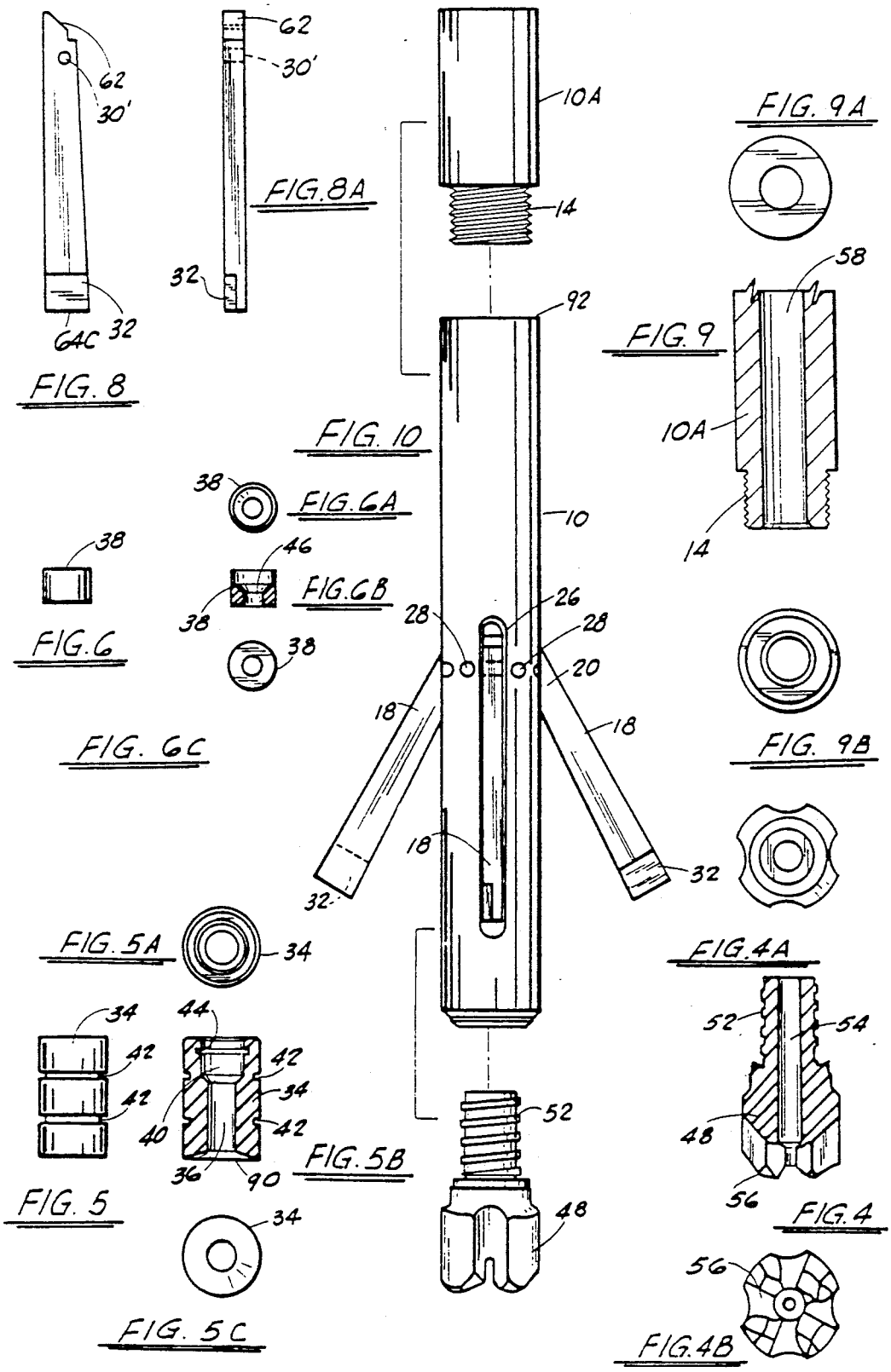
FIG. 4 is a cross-sectional view, including top and bottom end views, FIGS. 4A and 4B, of a bit for attachment to the lower end of the tool body as shown in FIG. 1.
FIGS. 5 and 5B are side and cross-sectional views of a piston, including top and bottom end views, FIGS. 5A and 5C, for being slidably disposed in a bore in the tool body of the tool system of FIG. 1 as shown in FIG. 3.
FIGS. 6 and 6B are side and cross-sectional views, including top and bottom end views, FIGS. 6A and 6C, of a cylindrical orifice for inserting in a counterbore in the piston of FIG. 5.
FIGS. 8 and 8A are side and rear views of a further preferred embodiment of an elongated blade pivotally attached to the body of the tool system of the method and apparatus of the present invention shown in FIG. 1.
FIG. 9 is a side, cross-sectional view, including top and bottom end views, FIGS. 9A and 9B, of a connecting sub used for connecting the tool body of the tool system of FIG. 1 to the tubing string.
FIG. 10 is a further exploded, side detail view of portions of tool system according to the method and apparatus of the present invention as shown in FIG. 1, showing the tool body, the tubing string and the drill bit.

Pivotally attached to body 10 is an elongated blade 18. As best seen in FIGS. 1 and 10 there may be a plurality of blades 18, and, as shown in the figures, four blades 18 are spaced equally around the circumference of the tool body with each blade 18 attached to body 10 by having its upper end 20 pivotally connected to the body 10 by suitable means such as an unseen pin.

As seen in FIG. 3, a bore 22 is also included in body 10 which extends axially from counterbore 16 into body 10 and terminates in an annular shoulder 24. An elongated slot 26 for each blade 18 is also included and extends radially into body 10 and intersects with bore 22 communicating with bore 22. Each slot 26 has its longitudinal axis aligned with the longitudinal axis of body 10, and a blade 18 is positioned within each slot 26 with its upper end, as mentioned, pivotally connected by means of the unseen pin within the upper end of slot 26. As indicated in FIGS. 1 and 10, the pivotal connection may be by providing body 10 with a bore 28 which extends laterally through slot 26 and a suitable bore as indicated by phantom lines 30 in blade 18, through which the pivot pin when inserted in bore 28 may rotatively pass, allowing blade 18 to pivot around the pin in slot 26. As further shown in FIG. 2, blades 18 have a first configuration, wherein each blade 18 is positioned within slot 26; and a second configuration as shown in FIGS. 1 and 10, wherein the blade is positioned radially outward to extend its distal unconnected end 32 radially outward short of contacting the interior surface of the casing 70.

As shown in FIGS. 3 and 5, a preferred movement means for moving the blade 18 radially outward to its second configuration is seen. The movement means is responsive to an increase in pressure in the interior of tubing string 12 and includes a piston means in the form of a cylindrical elongated piston 34 having an axial bore 36 therethrough and an interchangeable orifice 38 as seen in FIG. 6, which is inserted into a counterbore 40 extending axially downward into piston 34. As may be appreciated, unseen O-rings located in annular grooves 42 surrounding piston 34 establish a seal between piston 34 and the wall of bore 22 for preventing fluid from bypassing orifice 38. As may be further appreciated, a further unseen O-ring located in annular groove 44 provides a sealing engagement between orifice 38 and piston 34 to also prevent fluid from bypassing orifice 38.

Orifice 38 allows a pressure drop across piston 34, so that a high pressure occurring from the pressure in the fluid from tubing string 12 will be reduced by the restriction to produce a lower pressure in the potion of bore 22 below piston 34.

As orifice 38 is preferably interchangeable, the bore 46 of the orifice may be provided in differing diameters for controlling the downward force that piston 34 may provide. By varying the diameter of bore 46 the pressure drop across piston 24 may be varied. This allows the higher pressure in bore 22 above piston 34 to act selectively on a shoulder means on the upper end of the piston means, which is provided by an annular shoulder 48 surrounding the orifice 38, which communicates with the interior of the tubing string 12 by means of bore 22, thus moving piston 34 downward with a selected force responsive to a higher pressure in the interior of the tubing string 12.

As best shown in FIGS. 4 and 10, a standard bit 48 may extend axially from the lower end of body 10. Accordingly, body 10 would be provided with a counterbore 50, as shown in FIG. 3, in its lower end into which the threaded end 52 of bit 48 may be threadably engaged. Bit 48 may be any suitable bit known to the art and may include an axial bore 52 therethrough. Accordingly, counterbore 50 is provided with a suitable depth, so that it communicates with slot 26 and hence by means of slot 26 and bore 22, communicates with the interior of the tubing string 12 above for communicating fluid through bore 54 to lubricate the drill end 56 of bit 48 as it is rotated. As may be appreciated, the sub 10A includes an axial bore 58 for communicating fluid and pressure through the length of its body and includes suitable portions on its upper and lower end for connecting to tubing string 12 and tool body 10 respectively. As shown in FIG. 9, the connecting means on sub 10A may be a threaded portion 14, which extends axially from sub 10A.

Referring to FIGS. 7-8, a series of preferred embodiments for blade 18 are shown. As shown in the figures, each blade includes a bore 30' through which a pivot pin is slidably inserted for allowing pivoting rotation of the blade 18 about its pivotal connection. Each end 32 of blade 18 is provided with a tungsten carbide tip to increase their cutting capabilities.

As shown in FIGS. 7–8, a cam face 62 on blade 18 extends upward into bore 22. As may be appreciated, cam face 62 may be located on blade 18 above bore 30 and forms an obtuse angle with the vertical extension of the longitudinal axis of body 10. When the cam face 62 is acted upon by the downward movement of piston 34, in bore 22 contacting cam face 62, cam face 62 is caused to rotate downward about its pivotal connection in bore 30 and the distal end 32 of blade 18 extends radially outward.

As may be appreciated, a limiting means is included in bore 22 for limiting the downward movement of piston 34 responsive to higher pressure in the interior of tubing string 12. As shown in FIG. 3, the limiting means includes an annular shoulder 24 which when connected by piston 34 limits the downward movement of piston 34 and hence the radial outward extension of blade 18. As may be appreciated, blade 18 is configured so it is rotatable between its first configuration and an expanded configuration in which a blade 18 extends laterally from the elongated body, and, as may be understood, its second configuration lies between its first configuration and a horizontal configuration. Further, an increase in the obtuse angle would increase the radial extension of the distal end toward the lateral configuration until blade 18 has assumed its desired lateral configuration. As may be appreciated, all blades 18 may be manufactured of equal length, with only the cam face 62 of blades 18 modified to control the maximum limit of expansion.

As further shown in FIGS. 7–8, tip 32 may be provided with an angular, curved or straight cutting edge 64A, 64B, 64C respectively, although other configurations for the blade edges may also be used.

Referring again to FIG. 1, an inner tubular member 66, generally termed a production string, is shown which extends downward through a generally vertical outer tubular member 68, generally a casing, which is disposed in the well bore 70. As may be appreciated, the inner tubular member 66 extends downward through the outer tubular member 68 and terminates in a zone 72 in the well bore. The termination may be within the zone 72 or a suitable distance above the zone 72 and the outer tubular member 68 usually extends through the zone 72. The outer tubular member 68 is usually perforated in the zone 72 for producing the zone 72, and as mentioned in the background, a sand screen may be set to restrict entry of said grains from unconsolidated formation into the outer tubular member 68 and inner tubular member 66. As shown in FIG. 1, the inter tubular member may extend concentrically through the outer tubular member 68, or for multiple completions may extend asymmetrically downward through the outer tubular member 68.

An isolation means is included for isolating zone 72 from an annulus 74 between the tubular members 66, 68 for communicating the zone 72 with the interior of the inner tubular member 66. As may be appreciated, the isolation means is usually an annular packer 76 which extends radially between the inner tubular member 66 and the outer tubular member 68 for preventing communication between the isolating zone 72 and the annulus 74. The packer 76, as may be understood prevents communication between the zone 72 and annulus 74 and allows the zone 72 to be produced through the inner tubular member 66. The packer 76, zone 72, inner and outer tubular members 66, 68, the unseen perforations, any sand screen which may be present, as well as annulus 74 already exist down hole for producing the zone 72 and are known to the art. As discussed in the background of the invention, the zone 72 becomes filled with debris, and restrictive flow from the zone 72 to the interior of the inner tubular member 68 has occurred.

As flow from zone 72 has become restricted or has ceased, clean out of zone 72 below the packer is required. With the present tool system S, the tubing string 12, sub 10A, and tool 10 are selected so that they may be lowered through the interior of the inner tubular member 66, which may have for example a diameter such as three and a half inches. As the length of each section making up tubing string 12 generally has a standard length, sub 10A may be provided in a selected length so that as tool body 10 is lowered generally vertically through the inner tubular member with blades 18 in their first configuration and positioned generally vertical, the blades 18 may be lowered downward by longitudinal movement of the tubing string 12 through the tubing 66, until body 10 is extended into zone 72 and the blades 18 are positioned within zone 72.

During lowering of the tubing string 72 and the tool 10, string 12 may be rotated and fluid passed through the interior of string 12 and out through bore 54 by means of a pump at the surface as known to the art, and connected to tubing string 12 for communicating fluid and pressure to the interior of tubing string 12 to lubricate bit 48 as it is rotated. As may be appreciated, the rotation of bit 48 allows any scale or debris which is accumulated inside the interior of tubular member 66 to be loosened allowing the tool to be lowered to depth within zone 72. As the tool body 10 reaches zone 72 entry into zone 72 may be restricted by the debris 80 within the zone 72. Accordingly, the rotation of bit 56 allows the tool 10 to initially enter the zone 72 with blades 18 in their first configuration.

With the blades 18 positioned within zone 72, the pump pressure may be increased to cause piston 34 to move downward and contact cam face 62 and begin to extend blades 18 radially outward. Rotation of the tubing string 12 about its longitudinal axis along with longitudinal movement of the tubing string 12 may allow the blades 18 to move longitudinally in zone 72, allowing the debris 80 within the zone 72 to be loosened. Continued pressure from the pump will allow the piston 34 to extend the blades 18 radially outward as they move longitudinally and rotate within zone 72 until the full radial extension of blades 18 is reached. Continued longitudinal movement and rotation of blades 18 in the zone 72 by means of the tubular member 12 continues to loosen the debris 80 in the zone 72 until the full radial extension of blades 18 is reached, allowing the zone to again be produced.

During the loosening procedure, fluid is circulated into zone 72 through slot 26 and the passage 54 in bit 48. Circulation of fluid into the zone 72 allows the debris 80 to be carried out of the zone 72 upward in the annulus 82 between the tubing string 12 and the interior of the inner tubular member 66.

When the debris 80 has been sufficiently loosened and circulated out of the zone 72, the pump pressure may be lowered, allowing the blades 18 to assume their first configuration within body 10. At this point the tubing string sub 10A, if it is present, and the tool 10 may be withdrawn from the interior of the inner tubular member 66 and production of zone 72 within the interior of tubular member 66 may again resume.

From the foregoing the tool system S includes basically two parts, the tool body 10 itself (and its associated elements) and the standard pilot tungsten carbide bit 48. The maximum outside diameter of each is dependent on the minimum inside diameter of the production tubing 30, with the bit 48 normally being for example one-eighth inch diameter larger than the body 10.

The body 10 contains internally the hydraulic piston 34, interchangeable orifice 38 and for example, three or four, pivoting, tungsten carbide tipped, expanding, clean-out blades 18. The size of the bore 46 of orifice 38 is determined by the available hydraulic horsepower of the pumping equipment, at the surface, to expand the blades 18 for cleaning out casing 68 below the tubing packer 76. The maximum diameter to which these blades 18 will expand, without damage to the internal wall of the casing 76, is controlled by the obtuse angle of cam face 62 on the blades 18 above its pivotal connection between blades 18 and body 10 that contacts the bottom edges 90 of the hydraulic piston 34.

As mentioned, all blades may be manufactured of equal length, with only the cam portion 62 of the blades 18 modified to control the maximum limit of expansion. The top 92 of the tool 10 contains a removable top sub 10A to connect to the small diameter conveying tubing 12 and for replacement or repair of the hydraulic piston 34 and the variable size interchangeable orifice 38.

An exemplary method of the present invention is increasing or restoring production from an oil or gas well is outlined as follows:

(1) Determine the minimum inside diameter of the production tubing, including any accessory equipment installed in the string. Determine the minimum inside diameter of the casing 68 below the tubing packer 76, and the maximum bottom hole pressure of the producing formation in zone 72 by measurement of the pressure in zone 72.

(2) Select the proper sized and type hoisting and pumping equipment and circulating fluid.

(3) Affix the tool 10 to the conveying tubing 12.

(4) Lower the tool 10 down inside the producing tubing 66 until an obstruction is encountered.

(5) Begin pumping down the conveying tubing 12 and applying rotation around the vertical axis of tubing 12 until the obstruction has bee cleaned out by the bit 48. The expandable blades 18 will remain in a closed or vertical mode during this operation due to the close tolerance of the outside diameter of the tool 10 and the inside diameter of the production tubing 66. Continue this procedure to packer depth as required.

(6) At packer depth or bottom of the production tubing 66, begin fluid circulation down the conveying tubing 12. This circulation will activate the expandable blades 18 to a diameter equal to the inside diameter of the casing 68 (or screen if one is present) below the packer 76. Apply rotation as before until a predetermined depth below the producing formation has been achieved, and all debris 80 has been circulated from the well.

(7) Discontinue circulation, causing the expandable blades 18 to retract and remove the conveying tubing 12 and tool 10 from the well.

As an alternate to limiting the outwardly expansion of the clean-out blades by the taper on the upper ends of the blades, rollers or other slidable stops could be located at the outer, distal ends of the blades, so that these stops engage the interior surfaces of the casing. This insures that the cutting parts of the blades do not destructively engage the interior surfaces of the casing. Thus, the clean-out blades do not and cannot function as a casing cutter.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A method of removing debris located in a production zone below a packer in an oil well or the like having an inner tubular member of a relatively small diameter of about 2 ½–4 ½ inches in diameter which extends longitudinally downward through a generally vertical outer tubular member longitudinally disposed in the well and terminates in a zone isolated from the annulus between the tubular members by the packer for producing the well through the interior of the inner tubular member, which debris is restricting flow from the zone to the interior of the inner tubular member, comprising the steps of:

(a) lowering an elongated body having a relatively small horizontal cross-section having an effective diameter of less than said relatively small diameter connected to a down-hole motor at the end of a coil tubing string downward through the inner tubular member, the effective diameters of said body, said down-hole motor and said coil tubing string being less than that of said inner tubular member, until said body is located below the packer, positioning an elongated blade disposed within the body by means of longitudinal movement of the coil tubing string so that at least said body is positioned down within the zone;

(b) moving the blade radially outward toward the interior surface of said outer tubular member;

(c) limiting the movement of the blade radially outward preventing the blade from cuttingly engaging the interior surface of the outer tubular member; and (d) actuating the down-hole motor to rotate the blade within the zone, loosening the debris located in the zone within the interior of the outer tubular member.

* * * * *

UNITED STATES PATENT AND TRADEMARK OFFICE

CERTIFICATE OF CORRECTION

PATENT NO. : 5, 076,365

DATED : December 31, 1991

INVENTOR(S) : Robert L. Jenkins

It is certified that error appears in the above-identified patent and that said Letters Patent is hereby corrected as shown below:

Title page;

Abstract, line 22, delete "onthe" and substitute --on the-- therefor.
Column 1, line 19, delete "radically" and insert --radially-- therefor.
Column 2, line 18, delete "took" and insert --tool-- therefor.
Column 2, lines 27-28, delete "without" and insert --with-- therefor.
Column 2, line 37, delete "clan-out" and insert --clean-out-- therefor.
Column 4, line 31, delete "potion" and insert --portion-- therefor.
Column 5, line 54, delete "inter" and insert --inner-- therefor.
Column 6, line 26, delete "72" and insert --12-- therefor.
Column 7, line 32, delete "is" and insert --of-- therefor.
Column 7, line 46, delete "producing" and insert --production-- therefor.
Column 7, line 50, delete "bee" and insert --been-- therefor.

Signed and Sealed this

Tenth Day of March, 1992

*Attest:*

HARRY F. MANBECK, JR.

*Attesting Officer*

*Commissioner of Patents and Trademarks*